US005447490A

United States Patent [19]

Fula et al.

[11] Patent Number: 5,447,490

[45] Date of Patent: Sep. 5, 1995

[54] FINGER REHABILITATION SYSTEM

[75] Inventors: Karen A. Fula, Milwaukee; Debra A. Reina, Menomonee Falls; Kim M. Pederson, Delafield, all of Wis.

[73] Assignee: Smith & Nephew Rolyan, Inc., Germantown, Wis.

[21] Appl. No.: 279,265

[22] Filed: Jul. 21, 1994

Related U.S. Application Data

[63] Continuation of Ser. No. 992,049, Dec. 17, 1992, abandoned.

[51] Int. Cl.[6] ..... A63B 23/16

[52] U.S. Cl. ..... 601/40; 482/47; 482/49; 482/124; 602/21

[58] Field of Search ..... 602/5, 21, 22, 30, 64; 482/47, 49, 44, 121, 122; 2/161.1, 161.2, 161.4, 161.6, 162, 166; 601/40; D21/198; D24/190; 273/188 R, 189 R, 189 A; 473/61; 128/878, 879

[56] References Cited

U.S. PATENT DOCUMENTS

| | | | |
|---|---|---|---|
| 494,197 | 3/1893 | Hall . | |
| 2,108,236 | 2/1938 | Scott | 482/47 |
| 2,312,523 | 3/1943 | Corbett . | |
| 3,347,547 | 10/1967 | Hynes | 482/47 |
| 3,421,500 | 1/1969 | Jacobson . | |
| 3,581,312 | 6/1971 | Nickels | 2/161 A |
| 3,606,316 | 9/1971 | Krewer . | |
| 3,756,222 | 9/1973 | Ketchum | 128/26 |
| 3,815,587 | 6/1974 | Guerrant | 602/21 |
| 3,880,426 | 4/1975 | Morse | 473/61 |
| 4,047,250 | 9/1977 | Norman | 602/64 |
| 4,084,586 | 4/1978 | Hettick | 602/64 |
| 4,584,993 | 4/1986 | Nelson | 602/21 |
| 4,644,938 | 2/1987 | Yates et al. . | |
| 4,772,012 | 9/1988 | Chesher . | |
| 4,790,301 | 12/1988 | Silfverskiold . | |
| 4,796,306 | 1/1989 | Mitchell | 273/188 R |
| 4,831,997 | 5/1989 | Greene | 24/306 |
| 4,854,309 | 8/1989 | Elsey | 602/21 |
| 4,875,469 | 10/1989 | Brook et al. . | |
| 4,881,275 | 11/1989 | Cazares et al. | 2/161 A |
| 4,881,275 | 11/1989 | Cazares et al. | 482/47 |
| 4,949,711 | 8/1990 | Gyovai et al. | 602/21 |
| 4,977,890 | 12/1990 | Mann . | |
| 5,010,878 | 4/1991 | Kline et al. | 128/26 |
| 5,186,698 | 2/1993 | Mason et al. | 128/25 B |

FOREIGN PATENT DOCUMENTS

| | | | |
|---|---|---|---|
| 2576512 | 8/1986 | France | 602/21 |
| 2916894 | 11/1980 | Germany | 602/30 |

*Primary Examiner*—Richard J. Apley
*Assistant Examiner*—Jeanne M. Clark
*Attorney, Agent, or Firm*—Pravel, Hewitt, Kimball & Krieger

[57] ABSTRACT

The present invention relates to a finger rehabilitation system which has a gauntlet constructed of an elastomeric material, shaped to fit the center portion of a human hand extending past the wrist with securing means for releasably securing the gauntlet to the hand and finger attachment means for selectively rehabilitating the joints of the fingers, having securing means for releasably securing to the gauntlet.

11 Claims, 4 Drawing Sheets

FIG. 4
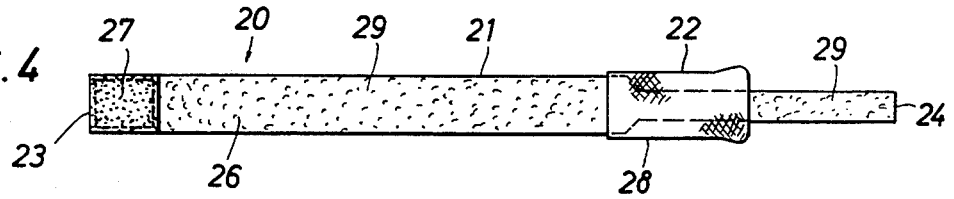
FIG. 5
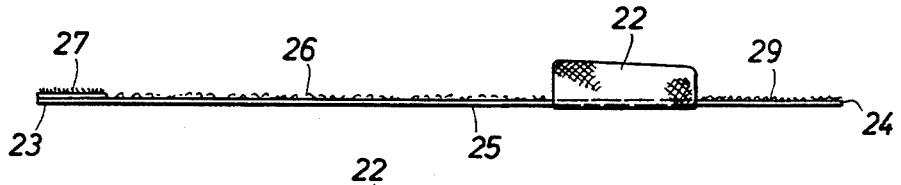
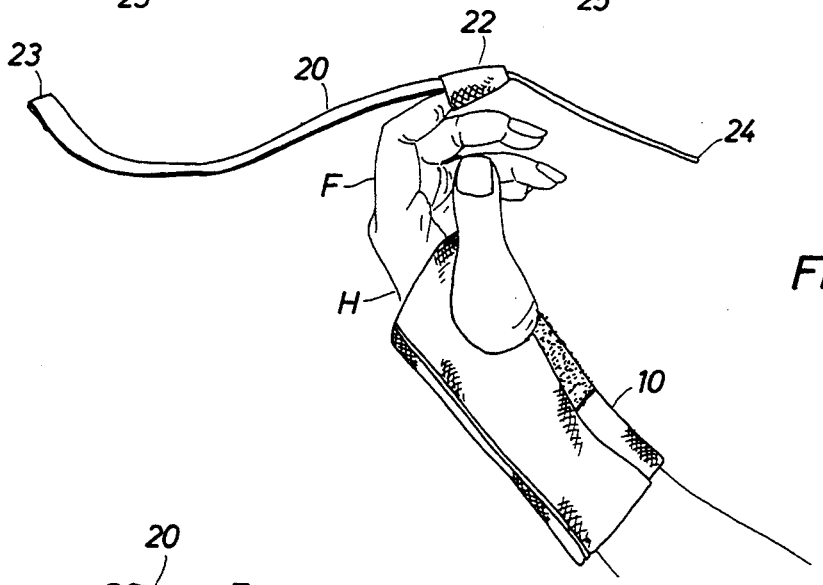
FIG. 6
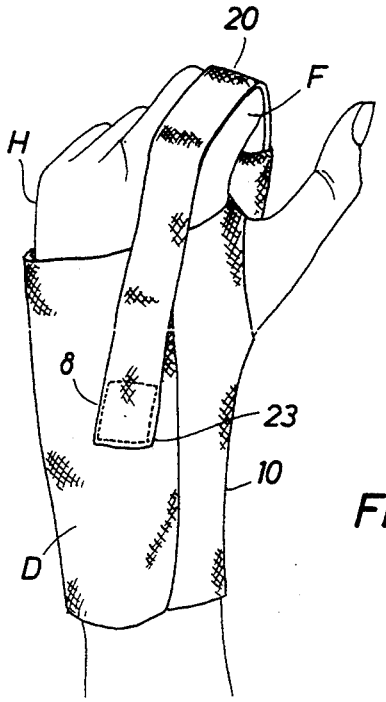
FIG. 7
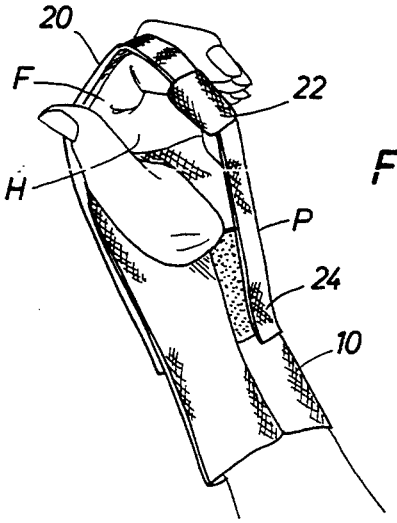
FIG. 8

FIG. 9
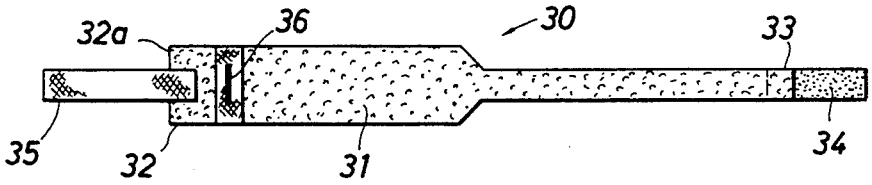
FIG. 10
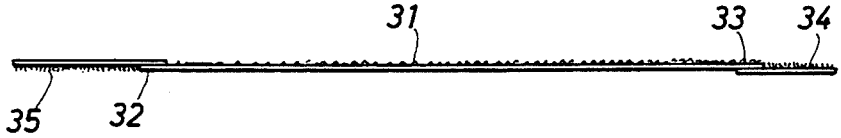
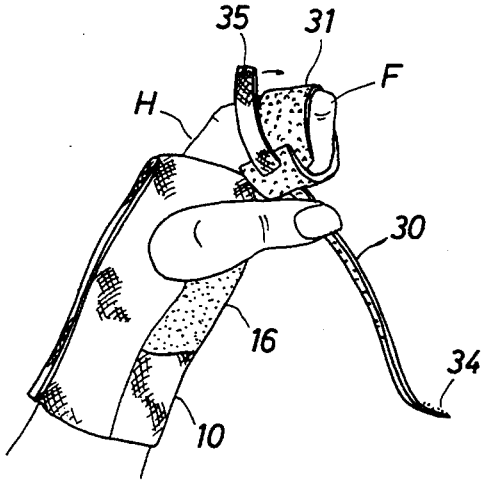
FIG. 11
FIG. 12
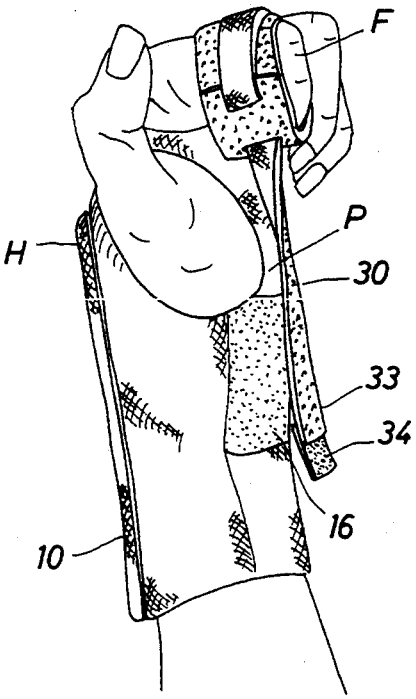
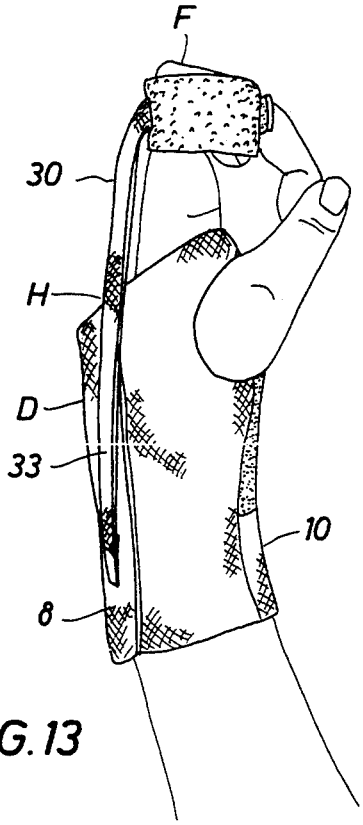
FIG. 13

FIG. 14
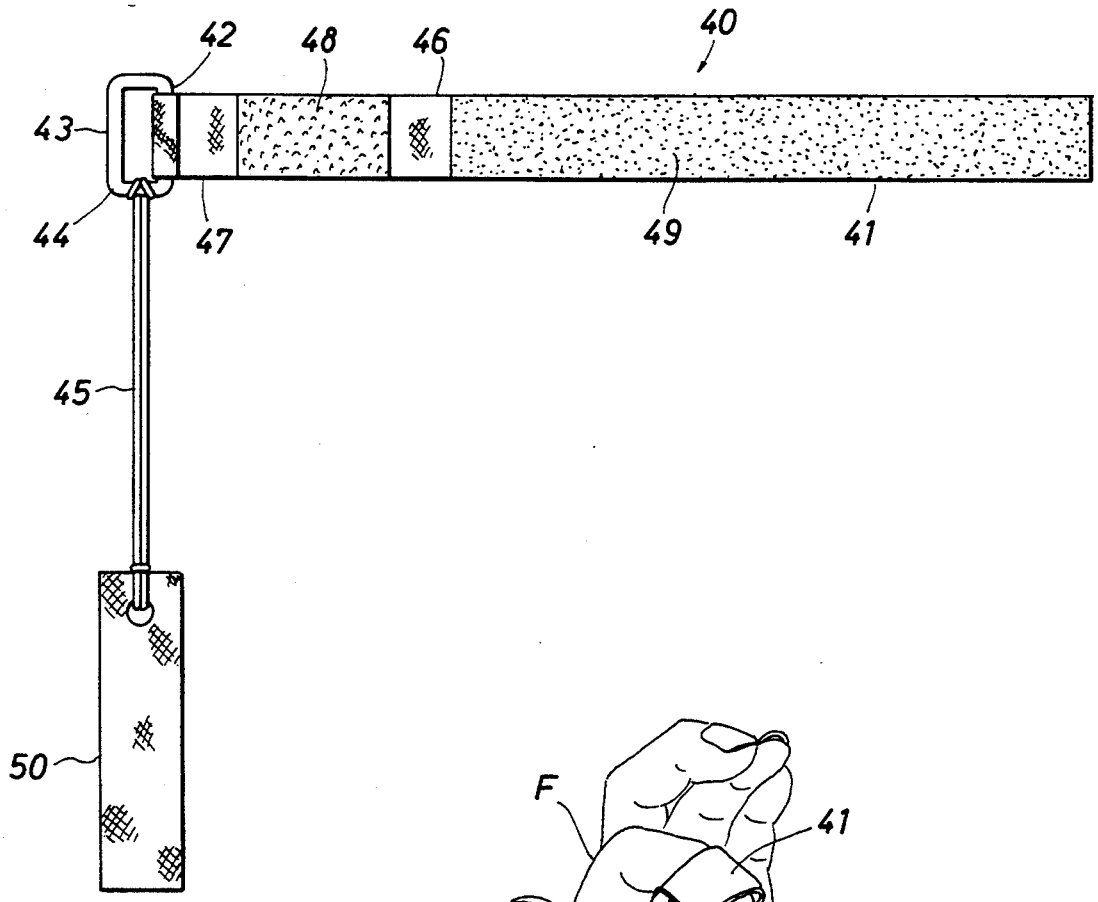
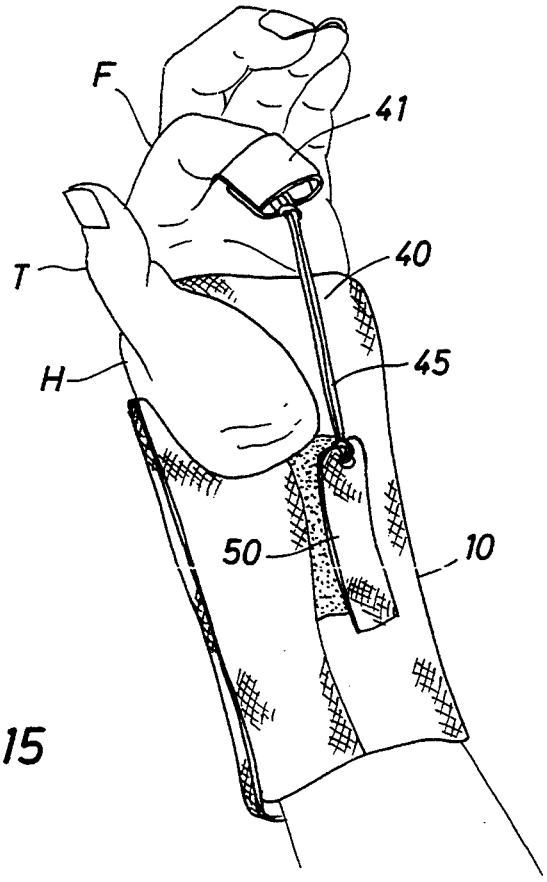
FIG. 15

FINGER REHABILITATION SYSTEM

This is a continuation of application Ser. No. 07/992,049 filed on Dec. 17, 1992 now abandoned.

FIELD OF THE INVENTION

This invention relates to a system for rehabilitating the fingers following an injury, pre or post surgery, or a disease of the hand.

BACKGROUND OF THE INVENTION

The subject invention provides a way of rehabilitating the hand by increasing the range of motion of the joints of the fingers, by providing static progressive stretch to the intrinsic and extrinsic tendons, ligaments, muscles or soft tissue, by providing composite finger flexion, and by strengthening the fingers. When a hand has been injured or diseased, the range of motion of the fingers becomes limited. As a result of the limited motion, the fingers tend to lose their strength which reduces their gripping and prehension ability.

Passive motion devices for exercising the hand have been developed such as, for example, the ones described in U.S. Pat. Nos. 4,644,938 and 4,875,469, where motors and cables move the fingers through flexion and extension. These devices are expensive and designed to be used by a patient who is incapacitated and not for a patient who has the ability to move his or her fingers but needs to exercise and strengthen them.

Other systems have been developed where gloves include eyelets for receiving tension members that are also connected to hooks on the patient's wrist (see U.S. Pat. No. 3,347,547) or hooks are glued onto the patient's fingernails. These and other systems where the hooks or eyelets are designed to be connected to a specific part of the fingers (see U.S. Pat. Nos. 494,197 and 4,790,301) have been found to be less than satisfactory because they cannot be adapted to fit various sized fingers or various placement on one or more fingers depending on the needs of the patient.

There is a need for a finger rehabilitation system that achieves the full range of finger flexion including composit finger flexion and stretch of the intrinsic and extrinsic muscles and tendons, provides both active and isotonic exercise of the hand, allows for the blocking of certain joints while working on others, and strengthens the fingers after the full range of motion has been achieved.

SUMMARY OF THE INVENTION

The invention solves the problems discussed above by providing a finger rehabilitation system which can selectively be applied to one or more fingers, can be individualized for specific therapeutic needs of each finger and can be used to both increase the range of motion and to strengthen the patient's fingers.

In order to better illustrate the invention, a definition of relevant descriptive terms relating to the hand is useful. The proximal side of the hand refers to the portion of the hand near the wrist. The radial side is the thumb side of the hand, and the ulnar side refers to the side of the hand away from the thumb. The palmar portion of the hand is the inside of the hand at the palm. The dorsal side of the hand is the back of the hand.

Starting from the tip of each finger, the first joint is called the distal interphalangeal joint, the second joint the proximal interphalangeal joint, and the third joint the metacarpophalangeal joint. The phalanges are small bones of the finger, located between the metacarpophalangeal joint and the tip of the finger.

The finger rehabilitation system of the invention includes a circumferential gauntlet that wraps around the hand and wrist and has a cut-out opening for a thumb. The gauntlet is preferably formed of neoprene like material to provide a non-slip connection to the patient's hand. The gauntlet has overlapping ends on the dorsal side of the hand with hook and loop fasteners such as VELCRO TM for holding the ends together.

The gauntlet is used with three different finger attachments to increase both range of motion and strength of the fingers. One attachment, the dorsal flexion hood attachment, is designed to increase passive joint motion by providing static progressive stretch to the tendons, ligaments and muscle structures of the metacarpophalangeal, distal interphalangeal and proximal interphalangeal joints by increasing tendon excursion. It mirrors the anatomical line of tendon excursion for flexion and intrinsic muscle structures and tendons, and allows for composite finger flexion. This finger attachment is formed of a soft strap with an elasticized finger hood or finger tip cover. One end of the strap attaches to the dorsal side of the gauntlet, and the other end attaches to the palmar side of the gauntlet with a VELCRO TM fastening system. The amount of static progressive traction applied to the joints of the fingers is determined by the placement of the strap ends on the gauntlet.

A second attachment, is a finger flexion loop attachment, which is designed to achieve the end ranges of metacarpophalangeal, distal interphalangeal and proximal interphalangeal joint flexion and composite finger flexion. This attachment is formed of a flexible strap that wraps around the first and third phalanx of the finger to increase proximal interphalangeal and distal interphalangeal joint flexion. The strap also attaches to the palmar side of the gauntlet, pulling the metacarpophalangeal joint into flexion. Again the amount of static progressive traction applied can be varied to meet the rehabilitation needs of each digit. This second finger attachment can also be applied to the first and third phalanx of the finger in a reverse position, by attachment to the dorsal side of the gauntlet, to allow extension of the metacarpophalangeal joint and stretching of the intrinsic tendons of the hand.

The third attachment is a finger exerciser attachment, which is designed to strengthen the fingers. A strap, secured to one side of a D-ring having a rubber band or other tensioning device secured to another side, is wrapped around the finger. The rubber band has a VELCRO TM fastening tab which can be secured to the palmar side of the gauntlet for allowing varying degrees of finger muscle resistance. This attachment can also be used on the thumb to strengthen extension and abduction of thumb motions.

BRIEF DESCRIPTION OF THE DRAWINGS

The invention will become more apparent when the detailed description of exemplary embodiments is considered in conjunction with the appended drawings, in which:

FIG. 4 is a plan view of the posterior side of a dorsal flexion hood attachment according to the present invention;

FIG. 5 is side view of the dorsal flexion hood attachment;

FIG. 6 is a perspective view illustrating the dorsal flexion hood attachment of FIGS. 4 and 5 attached to the finger of a human hand;

FIG. 7 is a perspective view illustrating the dorsal flexion hood attachment of FIGS. 4 and 5 applied to a finger of a human hand and attached to the dorsal side of the gauntlet of the present invention;

FIG. 8 is a perspective view illustrating a dorsal flexion hood attachment of FIGS. 4 and 5 applied to a finger of a human hand and attached to the palmar side of the gauntlet of the present invention;

FIG. 9 is a plan view of the anterior side of a finger flexion loop attachment according to the present invention;

FIG. 10 is a side view of the finger flexion loop attachment shown in FIG. 9;

FIG. 11 is a perspective view illustrating the finger flexion loop attachment of FIGS. 9 and 10 applied to the finger of a human hand;

FIG. 12 is a perspective view of the finger flexion loop attachment of FIGS. 9 and 10 applied to a finger of a human hand and attached to the palmar side of the gauntlet of the present invention;

FIG. 13 is a perspective view of the finger flexion loop attachment of FIGS. 9 and 10 applied to a finger of a human hand and attached to the dorsal side of the gauntlet of the present invention; finger of a human hand and attached to the dorsal side of the gauntlet of the present invention;

FIG. 14 is a plan view of the anterior side of a finger exerciser attachment according to the present invention;

FIG. 15 is a perspective view illustrating the finger exerciser attachment of FIG. 14 applied to a finger of a human hand and attached to the palmar side of the gauntlet of the present invention.

DETAILED DESCRIPTION OF A PREFERRED EMBODIMENT

Figure 1:
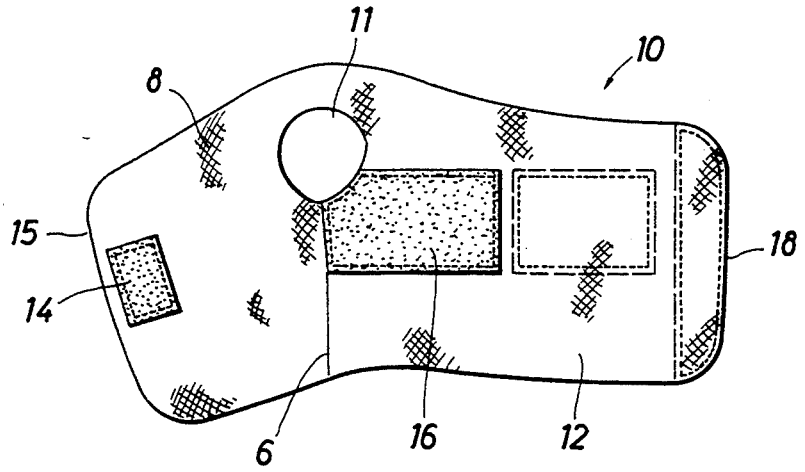
FIG. 1 is a plan view of the exterior surface of a gauntlet according to the present invention.
Figure 2:
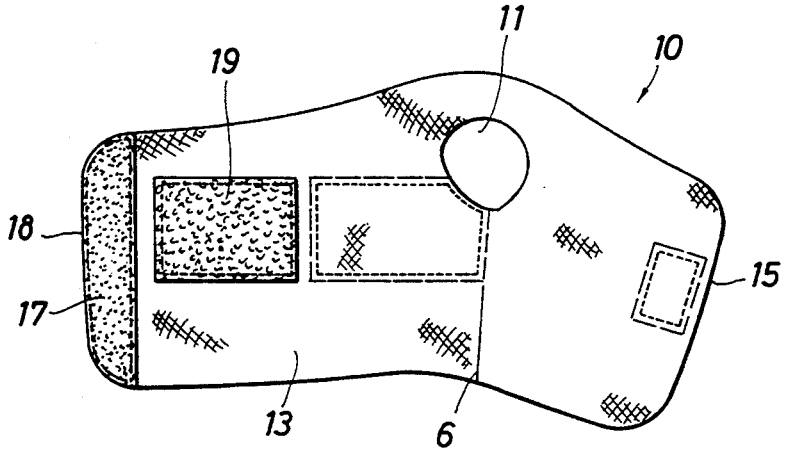
FIG. 2 is a plan view of the interior surface of a gauntlet according to the present invention.

The finger rehabilitation system includes a gauntlet 10 formed of a neoprene like material as shown in FIG. 1, and finger attachments 20, 30 and 40, as shown in FIGS. 4–8, 9–13 and 14–15, respectively. The gauntlet 10, illustrated in FIGS. 1, 2 and 3, wraps around a patient's hand H and wrist W, and has a cut-out opening 11 for a thumb T. An exterior surface 12 of the gauntlet 10 is covered with a fabric 8 that may be used as the fibrous or looped gender of a VELCRO TM fastening system, while an interior surface 13 is covered with a soft stretchable fabric. Preferably the gauntlet is formed of a double rubber laminate or similar material with one side having a fibrous loop or similar surface.

Overlapping edges 15 and 18 of the gauntlet 10 are snugly held together on the dorsal side D of the hand H with a VELCRO TM fastening system. As shown in FIG. 1, two sections 14, 16 of VELCRO TM hook fasteners are attached to the exterior surface 12 of the gauntlet 10. The fastener section 14 is preferably attached centrally along a radial end 15 of the gauntlet 10 for securing the overlapping gauntlet ends 15 and 18 together. The second fastener 16 is preferably attached to the palmar side P of the gauntlet 10, Two VELCRO TM fasteners 17, 19 are attached to the interior surface 13. The fastener 17 is formed of a hooked gender material and is preferably attached along the ulnar edge 18 of the gauntlet 10 for engagement with the fibrous or looped fabric 8 on the exterior surface 12 of the gauntlet 10. The fastener 19 is formed of a looped gender material and is preferably attached adjacent to the fastener 17 for engagement with the hook fastener 14 attached to the exterior side 12 of the gauntlet 10.

As shown best in FIG. 1, the gauntlet 10 is generally rectangular in shape, contoured to fit the natural curvature of the hand H, with a seam 6 down the side of the gauntlet 10 from the cut-out opening 11 for the thumb T to the proximal end E of the gauntlet 10. The gauntlet 10 is approximately 10.0 to 13.0 inches in length and 4.0 to 6.0 inches in width.

The gauntlet 10 can be used with at least three different finger attachments as shown in FIGS. 4–8, 9–13 and 14–15. The dorsal flexion hood attachment 20 shown in FIGS. 4 and 5, is formed of a long, soft strap 21 with an elasticized, circumferential finger tip cover 22 secured to the strap 21 between the strap ends 23, 24 on the interior side 26. The attachment 20 has an exterior side 25 covered with a fabric such as nylon tricot, while the interior side 26 is covered with a fabric 29 that may be used as the fibrous or looped gender of a VELCRO TM fastening system. A fastener 27, formed of a hooked gender material, is attached to one end 23 of the attachment 20, and engages with the fibrous or looped fabric 8 on the dorsal side D of the gauntlet 10 as shown in FIG. 7. The fabric 29 on the other end 24 of the attachment 20 engages with the hook fastener 16 on the palmar side P of the gauntlet 10 as shown in FIG. 8. Alternately, the narrow tail end 24 may be formed from a separate looped gender fastener and attached by suitable means to the strap 21 at a point 28.

The dorsal flexion hood attachment 20 is about 0.75 inches in width and can be up to 18.0 inches in length. The elasticized hood or finger tip cover 22 is preferably secured to the dorsal flexion hood attachment 20 approximately 7.5 inches from the end 23 on which the loop fastener 27 is attached. The elasticized hood 22 is secured to the attachment 20 at the point 28 on the strap 21, where the strap 21 tapers to a width of approximately 0.38 inches. The narrow tail end 24 may be up to 10.0 inches in length. The dorsal flexion hood attachment 20 is used to increase passive joint motion of the metacarpophalangeal, the distal interphalangeal and the proximal interphalangeal joints of the fingers by providing resistance to finger movement when connected as shown in FIGS. 7, 8.

The finger flexion loop attachment 30 shown in FIG. 9 and 10, is formed of an appropriate high-strength, fibrous fabric. A high tensile strength, loose-weave fabric with a hooked gender surface, 31 known as VELCRO TM laminate, is preferable. The attachment 30 is about 8.0 inches long and, at the widest end 32, is generally 1.0 inches wide. Approximately 4.0 inches from the end 32, the attachment 30 tapers to a width of generally 0.38 inches. The overall length of the attachment 30 is approximately 10.8 inches.

A fastener 34, formed of a hooked gender, is attached through a heat seal to the inside end 32 of the attachment 30, for engagement with the fastener 16 on the palmar area P of the gauntlet 10. A fastener 35, also formed of a hooked gender material, is attached through a heat seal to the wide end 32 of the attachment 30, facing in a direction opposite the hook attachment 34 at the narrow tail end 33. A slot 36 is formed about 0.5 inches from the wide end 32 of the attachment 30, centered and parallel to edge 32*a*, which is about 0.38 inches in length. The finger flexion hoop attachment 30 is used to achieve the end ranges of motion and composite finger flexion of the metacarpophalangeal, the distal interphalangeal and the proximal interphalangeal joints. When reversed the finger flexion loop attachment 30 stretches the intrinsic and extrinsic muscles of the finger. As illustrated in FIGS. 11, 12 and 13, the finger flexion loop attachment 30 wraps around the first and third phalanx of a finger F and then engages with the VELCRO TM fastener 16 and looped fabric 8 on the gauntlet 10.

The finger exerciser attachment 40 shown in FIGS. 14 and 15, is formed of a strap 41 attached to a long side 42 of a D-ring 43 with a tensioning device 45 attached to a short side 44 of the same D-ring 43. A tensioning device 45 such as, for example, a rubber band, elastic cord or spring may be used. The strap 41 is formed of a high strength, flexible, fibrous material generally 0.5 inches in width and generally 6.0 inches long. A loop portion 48, formed of a fibrous or looped gender material, is attached on the anterior side 46 of the strap 41, about 0.5 inches from the strap end 47, the loop portion 48 being generally 1.0 inches in length. Strap portion 49, which is the remaining portion of the strap 41, is formed of a hooked gender material. The strap 41 wraps around the end of a finger F and is fastened with the hook and loop gender portions 48 and 49 to the finger F. A tab 50, formed of a fibrous or looped gender material, is attached to the other end of the tensioning device 45 that extends from the short side 44 of the D-ring 43, for positioning anywhere on the fastener 16 on the palmar area P of the gauntlet 10. The finger exerciser attachment 40 is used to strengthen the fingers F as well as extension and abduction of the thumb T.

Figure 3:
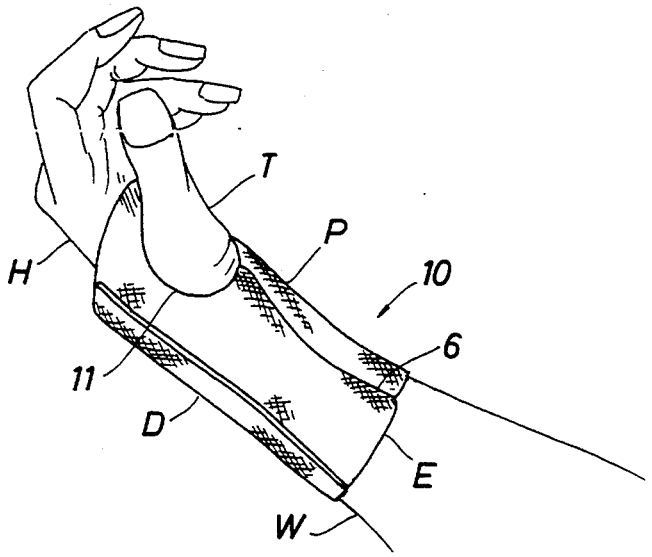
FIG. 3 is a perspective view of a gauntlet according to the present invention applied to a human hand.

In the use of the invention, the gauntlet 10 illustrated in FIG. 3 is applied to the patient's hand H so that the hooked portion 16 lies in the palmar area P of the hand H. When gauntlet ends 15 and 18 are brought together on the dorsal side D of the hand H, they overlap to achieve a snug fit around the hand H. If modifications to the gauntlet 10 are necessary, the neoprene like material can be cut or trimmed in the area surrounding the opening 11 for the thumb T and at the proximal end E of the wrist W.

As illustrated in FIG. 6, the dorsal flexion hood attachment 20 is secured to a finger F by inserting the tip of a finger F into the elasticized hood 22 of the attachment 20. The surface 26 of the dorsal hood attachment 20 lies face down on the skin allowing the surface 25 to appear face up. As shown in FIG. 7, the end 23 of the strap 21, extending over the dorsal side D of the hand H, has hooked fastener 27 for engagement with the fibrous or looped fabric 8 on the dorsal side D of the gauntlet 10. As shown in FIG. 8, the other end 24 of the strap 21, covered with fibrous or looped fabric 29, engages with the hooked fastener 16 on the palmar portion P of the gauntlet 10. The dorsal flexion hood attachment 20 is used to provide static progressive stretch to the tendons and muscles which mirrors the anatomical line of tendon excursion or pull found in natural anatomical flexion.

To apply the finger flexion loop attachment 30 to the finger F, the narrow tail end 33 of the attachment 30 is first inserted through the slit 36 so that the fibrous or looped fastening side 31 faces outward. The attachment 30 is then placed over the first and third phalanx of the patient's finger F as illustrated in FIG. 11. The wider end 32 of the attachment 30 is secured around the finger F by the hook fastener 35 and is adjusted to provide the required amount of distal interphalangeal and proximal interphalangeal joint flexion. As shown in FIG. 12, the narrow tail end 33 with the hook fastener 34, extends down toward the palm for engagement with the fastener 16 on the palmar area P of the gauntlet 10. This narrow tail end 33 adjusts for flexion of the metacarpophalangeal joint of the finger. As illustrated in FIG. 13, the finger flexion loop attachment 30 can be applied in the reverse position to achieve extension of the metacarpophalangeal joint and to stretch the intrinsic tendons and muscles of the hand. For this alternate position, the narrow tail end 33 extends from the dorsal surface of the proximal phalanx of the finger F and engages with the fibrous or looped fabric 8 on the dorsal side D of the gauntlet 10. This position allows maximum flexion of the proximal interphalangeal and dorsal interphalangeal joints while allowing extension of the metacarpophalangeal joint.

The use of the finger exerciser attachment 40 is illustrated in FIG. 15. The D-ring strap 41 is attached to the end portion of the finger F or at the end of a joint which is being emphasized for movement. The tensioning device 45 extends from the finger F toward the palm of the hand H and the tab fastener 50, attached to the tensioning device 45, engages with the fastener 16 on the palmar area P of the gauntlet 10. Adjustment of the tab 50 will vary the amount of resistance placed on the finger muscles.

Each of the finger attachments 20, 30 and 40 can be used to rehabilitate an individual finger of the hand or all fingers can be exercised simultaneously or in any combination thereof.

The finger rehabilitation system made in accordance with the invention offers the advantages of being able to achieve the full range of finger flexion including composite finger flexion, provides stretch to the tendons, ligaments and muscles involved in finger flexion, allows individualized placement on each finger which provides proper anatomical alignment of tendon pull and provides stretch to the intrinsic and extrinsic muscles of the hand. Additionally, the various finger attachments allow for rehabilitation according to the specific therapeutic goals for each finger and each finger can be rehabilitated according to its own natural therapeutic progression. Although the present invention has been described with reference to its preferred embodiments, those skilled in the art will recognize changes which may be made in form or structure which do not depart from the spirit of the invention already described in the specification and embodied in the claims which follow.

What is claimed is:

1. A finger rehabilitation system, comprising:

a) a gauntlet constructed of an elastomeric material, shaped to fit the center portion of a human hand and extending past the wrist;

b) securing means for releasable securing the gauntlet around the hand and wrist, being secured on the dorsal side of the hand;

c) finger attachment means for selectively engaging a finger and securing means for releasably securing said finger attachment means to the gauntlet, said finger attachment means and gauntlet together forming a finger rehabilitation system capable of providing a full range of movement in the selective rehabilitation of the fingers of a human hand so as to provide a full range of motion to the fingers and its joints;

d) said finger_attachment means further including at least two distinct and uniquely shaped finger attachment members configured to provide distinct and unique rehabilitative resistance for different positions and motions of the fingers wherein the user can selectively choose at least one of the finger attachment members to provide individualized rehabilitation of a finger.

2. The finger rehabilitation system of claim 1, wherein the gauntlet is generally rectangular in shape, having a cut-out opening for a thumb and being contoured to fit the curvature of the hand.

3. The finger rehabilitation system of claim 1, wherein the gauntlet is formed of a neoprene like material having one side covered with a material for use as the grappling gender of a hook and loop fastening system.

4. The finger rehabilitation system of claim 1 wherein, the securing means for securing the gauntlet includes materials having hook and loop genders of a fastening system.

5. The finger rehabilitation system of claim 1, wherein the at least two finger attachment member includes a first finger attachment member, said first finger attachment member comprising a strap having an elasticized, circumferential finger tip cover attached between the strap ends.

6. The finger rehabilitation system of claim 5, wherein the first finger attachment member includes securing means of material having hook and loop genders of a fastening system.

7. The finger rehabilitation system of claim 1, wherein the at least two finger attachment member includes a second finger attachment member, said second finger attachment member comprising a strap, having a wide end and a narrow end, for forming a loop around a finger.

8. The finger rehabilitation system of claim 7, wherein the second finger attachment member includes securing means of material having hook and loop genders of a fastening system.

9. The finger rehabilitation system of claim 1, wherein the at least two finger attachment member includes a third finger attachment member, said third finger attachment member comprising a D-ring having at least a first side and a second side, with a strap attached to the first side and an elastomeric band attached to the second side.

10. The finger rehabilitation system of claim 9, wherein the third finger attachment member includes securing means attached to the strap and elastomeric band, the securing means includes material having hook and loop genders of a fastening system.

11. A finger rehabilitation system, comprising:

a) a gauntlet constructed of elastomeric material having one side covered with a material for use as the grappling gender of a hood and loop fastening system, said gauntlet being generally rectangular in shape, having a cut-out opening for a thumb and being contoured to fit the curvature of the hand and extending past the wrist;

b) securing means for releasable securing the gauntlet around the hand and wrist, being secured on the dorsal side of the hand, said securing means including material having hook and loop genders of a fastening system;

c) finger attachment means for selectively engaging a finger, and securing means for releasably securing said finger attachment means to the gauntlet, said finger attachment means and gauntlet together forming a finger rehabilitation system capable of providing a full range of movement in the selective rehabilitation of the fingers of a human hand so as to provide a full range of motion to the fingers and its joints, said finger attachment means includes a first strap having an elasticized, circumferential finger tip cover attached between the strap end; a second strap having a wide end and a narrow end, for forming a loop around a finger; and a D-ring having at least a first side and a second side, with a strap attached to the first side and an elastomeric band attached to the second side, said securing means includes material having hook and loop genders of a fastening system.

* * * * *